US011130664B2

(12) United States Patent
Conway et al.

(10) Patent No.: US 11,130,664 B2
(45) Date of Patent: Sep. 28, 2021

(54) TILTING BUCKET

(71) Applicants: Matthew B. Conway, Boston, MA (US); Keith Homstad, East Grand Forks, MN (US)

(72) Inventors: Matthew B. Conway, Boston, MA (US); Keith Homstad, East Grand Forks, MN (US)

( * ) Notice: Subject to any disclaimer, the term of this patent is extended or adjusted under 35 U.S.C. 154(b) by 206 days.

(21) Appl. No.: 16/130,526

(22) Filed: Sep. 13, 2018

(65) Prior Publication Data

US 2019/0077645 A1 Mar. 14, 2019

Related U.S. Application Data

(60) Provisional application No. 62/558,560, filed on Sep. 14, 2017.

(51) Int. Cl.

| | |
|---|---|
| ***B66F 11/04*** | (2006.01) |
| ***B66F 17/00*** | (2006.01) |
| ***B66F 9/075*** | (2006.01) |

(52) U.S. Cl.

CPC ..... *B66F 11/044* (2013.01); *B66F 9/0759* (2013.01); *B66F 11/04* (2013.01); *B66F 17/006* (2013.01)

(58) Field of Classification Search

CPC ..... B66F 11/044; B66F 11/04; B66F 17/006; B66F 9/0759

See application file for complete search history.

(56) References Cited

U.S. PATENT DOCUMENTS 3,695,390 A * 10/1972 Leigh ..... B66F 11/046 182/129
3,917,026 A 11/1975 Hedges
(Continued)

FOREIGN PATENT DOCUMENTS

FR 2662150 A1 9/1992
FR 2876367 12/2006
(Continued)

OTHER PUBLICATIONS

International Search Report and Written Opinion for International Application No. PCT/US2018/050901, entitled "Tilting Bucket," dated Jan. 14, 2019.

(Continued)

*Primary Examiner* — Alvin C Chin-Shue
(74) *Attorney, Agent, or Firm* — Hamilton, Brook, Smith & Reynolds, P.C.

(57) ABSTRACT

A tilting support or work bucket, or apparatus for an aerial lift including a support frame for supporting an operator. The support frame can have a seat for supporting the operator when in an upright position and a chest support having a portion above and forward of the seat for supporting a chest of the operator when in a forwardly downward tilted position while allowing arms of the operator to extend forwardly out of the support frame. A support member can be pivotably mounted to the support frame at a pivot joint that is located at an upper portion of the support frame when the support frame is in the upright position, for pivotably supporting the support frame. An actuator can be included for positionably rotating the support frame relative to the support member about the pivot joint between the upright position and the forwardly downward tilted position. Since the pivot joint is located in the upper portion of the support frame, pivoting of the support frame from the upright position to the forwardly downward tilted position moves a center of grav- (Continued)

ity of the support frame rearwardly in the direction of the support member.

14 Claims, 14 Drawing Sheets

(56) References Cited

U.S. PATENT DOCUMENTS

| | | | | |
|---|---|---|---|---|
| 4,070,807 | A | 1/1978 | Smith, Jr. | |
| 4,160,492 | A | 7/1979 | Johnston | |
| 4,691,805 | A | 9/1987 | Kishi | |
| 4,857,723 | A | 8/1989 | Holmes et al. | |
| 4,883,145 | A * | 11/1989 | Deltatto | B66F 11/044 182/2.4 |
| 4,917,214 | A | 4/1990 | Mlaker et al. | |
| 6,224,154 | B1 * | 5/2001 | Stoki | A61B 90/60 297/338 |
| 6,330,931 | B1 * | 12/2001 | Baillargeon | A62B 35/0037 182/18 |
| 9,238,573 | B2 | 1/2016 | Luminet et al. | |
| 9,656,845 | B2 | 5/2017 | Dittus et al. | |
| 9,679,461 | B2 | 6/2017 | Cummings | |
| 2002/0074186 | A1 * | 6/2002 | Baldas | B66F 11/044 182/69.6 |
| 2005/0187712 | A1 * | 8/2005 | Callaghan | B66B 5/0031 701/301 |
| 2012/0160604 | A1 * | 6/2012 | Bowden | B66F 11/046 182/18 |
| 2015/0123432 | A1 * | 5/2015 | Ray | A61B 90/60 297/188.01 |
| 2016/0221812 | A1 * | 8/2016 | Puszkiewicz | B66F 17/006 |
| 2016/0332856 | A1 | 11/2016 | Steedley | |
| 2018/0132477 | A1 * | 5/2018 | Yelle | B66F 11/046 |
| 2018/0265336 | A1 * | 9/2018 | Xu | B66F 11/044 |
| 2019/0177140 | A1 * | 6/2019 | Gilbride | B66F 11/044 |

FOREIGN PATENT DOCUMENTS

| | | |
|---|---|---|
| WO | 2017178737 | 10/2017 |
| WO | 2019055668 A1 | 3/2019 |

OTHER PUBLICATIONS

"Haulotte 4527A Towable Articulated Boom Lift", https://www.youtube.com/watch?v=ICcbDbAk8IM, 57 sec./1:41, 2016.

"Plumber's Package", https://www.jlg.com/en/equipment/options/scissor-lift-options/plumbers-package?Cookie=language,language,language, 2018.

Teupen TC51A-57 FT; http://www.teupen-usa.com/lifts/canopy-series/tc51a-57-ft/.

Teupen TL44AJ; http://www.teupen-usa.com/lifts/leo-series/t144aj-leo-15gt-plus/.

Teupen TL63A;http://www.teupen-usa.com/lifts/leo-series/t163a/.

* cited by examiner

TILTING BUCKET

RELATED APPLICATION(S)

This application claims the benefit of U.S. Provisional Application No. 62/558,560, filed on Sep. 14, 2017. The entire teachings of the above application are incorporated herein by reference.

BACKGROUND

Aerial lifts are often used for working on construction projects. However conventional aerial lifts are often ergonomically unsuited to allow workers to work comfortably and easily on inclined surfaces.

SUMMARY

The present invention provides a tilting support frame, work platform, bucket, enclosure cage or apparatus for or part of an aerial lift that can tilt forwardly in an ergonomic and safe manner to allow workers to comfortably and easily work on inclined surfaces. The tilting apparatus can include a support frame for supporting an operator or worker. The support frame can have a seat for supporting the operator when in an upright position and a chest support having a portion above and forward of the seat for supporting a chest of the operator when in a forwardly downward tilted or facing position while allowing arms of the operator to extend forwardly out of the support frame. A support arm, boom extension or member can be pivotably mounted to the support frame at a pivot joint that is located at an upper portion of the support frame when the support frame is in the upright position, for pivotably supporting the support frame. An actuator can be included for positionably rotating the support frame relative to the support member about the pivot joint between the upright position and the forwardly downward tilted or facing position. Since the pivot joint is located in the upper portion of the support frame, pivoting of the support frame from the upright position to the forwardly downward tilted or facing position moves a center of gravity of the support frame rearwardly or backward in the direction of the support member.

In particular embodiments, the support member can include connection hardware for securing to a lifting portion of the aerial lift such as an arm or boom. The pivot joint can be positioned on the support frame in a location whereby tilting during work does not substantially change distance from the arms of the operator relative to a working surface. In some embodiments, the pivot joint can be positioned on the support frame in a location estimated to be near or at a shoulder joint of the operator so that the support frame pivots approximately about the location of the shoulder joint of the operator. The support frame can have a longitudinal axis that is vertical when the support frame is in an upright position. The pivot joint can be positioned along the longitudinal axis above the seat or above the center of gravity. The support member can be yoke shaped for pivotably supporting the support frame from two opposite sides. The actuator can include at least one of a rotary actuator, a motor, a linear actuator, and a fluid or gas operated cylinder. When the actuator is at least one of the linear actuator and the fluid or gas operated cylinder, the actuator can be connected between the support frame and the support member for rotating the support frame about the pivot joint. The tilting apparatus can further include foot operated controls for controlling operation of the actuator.

The tilting apparatus can also include a controller for controlling movement of the tilting apparatus. A safety restraint can be included for restraining the operator in the seat and can be electrically connected to the controller for allowing movement of the tilting apparatus only when the safety restraint is closed. One or more proximity sensors can be positioned on the support frame and electrically connected to the controller for controlling distance that the support frame can be moved toward an outside structure. One or more safety or break sensors can be positioned on the support frame and electrically connected to the controller for sensing presence of the operator's arms extending outside the support frame between the support frame and an outside structure and preventing movement of the support frame towards the outside structure to avoid pinching injuries of the operator's arms. The controller can include position and orientation memory functions that allow the tilting apparatus to move to at least one previously determined or stored desired location and/or orientation using the memory functions. At least one of a rack, container, platform or basket can be attached to the support frame for carrying at least one of supplies, work materials and tools.

The present invention can also provide an aerial lift with a tilting apparatus including a lift base with a lifting portion. A support frame can have a seat for supporting the operator when in an upright position and a chest support having a portion above and forward of the seat for supporting a chest of the operator when in a forwardly downward tilted position while allowing arms of the operator to extend forwardly out of the support frame. A support member can be pivotably mounted to the support frame at a pivot joint that is located at an upper portion of the support frame when the support frame is in the upright position, for pivotably supporting the support frame. The support member can be secured to the lifting portion of the aerial lift with connecting hardware. An actuator can positionably rotate the support frame relative to the support member about the pivot joint between the upright position and the forwardly downward tilted position. Since the pivot joint is located in the upper portion of the support frame, pivoting of the support frame from the upright position to the forwardly downward tilted position moves a center of gravity of the support frame rearwardly in the direction of the support member.

The present invention can also provide a method of using a tilting apparatus for or attached to an aerial lift including supporting an operator in a support frame. The support frame can have a seat for supporting the operator when in an upright position and a chest support having a portion above and forward of the seat for supporting the chest of the operator when in a forwardly downward tilted position while allowing arms of the operator to extend forwardly out of the support frame. The support frame can be pivotably supported with a support member pivotably mounted to the support frame at a pivot joint that is located in an upper portion of the support frame when the support frame is in the upright position. The support frame can be positionably rotated relative to the support member about the pivot joint with an actuator, between the upright position and the forwardly downward tilted position. Since the pivot joint is located at the upper portion of the support frame, pivoting of the support frame from the upright position to the forwardly downward tilted position moves a center of gravity of the support frame rearwardly in the direction of the support member.

In particular embodiments, the support member can be secured to a lifting portion of the aerial lift with connection hardware. The pivot joint can be positioned on the support frame in a location whereby tilting during work does not substantially change distance from the arms of the operator relative to a working surface. In some embodiments, the pivot joint can be positioned on the support frame in a location estimated to be near or at a shoulder joint of the operator so that the support frame pivots approximately about the location of the shoulder joint of the operator. The support frame can have a longitudinal axis that is vertical when the support frame is in the upright position. The pivot joint can be positioned along the longitudinal axis above the seat or above the center of gravity. The support member can be yoke shaped for pivotably supporting the support frame from two opposite sides. At least one of a rotary actuator, a motor, a linear actuator and a fluid or gas operated cylinder can be operated as the actuator. When the actuator is at least one of the linear actuator and the fluid or gas operated cylinder, the actuator can be connected between the support frame and the support member for rotating the support frame about the pivot joint. Operation of the actuator can be controlled with foot operated controls.

The tilting apparatus can further include a controller for controlling movement of the tilting apparatus. A safety restraint can restrain the operator in the seat and can be electrically connected to the controller for allowing movement of the tilting apparatus only when the safety restraint is closed. One or more proximity sensors can be positioned on the support frame and electrically connected to the controller for controlling the distance that the support frame can be moved toward an outside structure with the proximity sensors. One or more safety or break sensors can be positioned on the support frame and electrically connected to the controller. When sensing presence of the operator's arms extending outside of the support frame between the support frame and an outside structure, movement of the support frame towards the outside structure can be prevented to avoid pinching injuries of the operator's arms. The controller can include position and orientation memory functions for moving the tilting apparatus to at least one previously determined or stored desired location and/or orientation with the memory functions. At least one of supplies, work materials and tools can be carried in at least one of a rack, container, platform or basket attached to the support frame.

In some embodiments, the foot operated controls can include foot pedals. In other embodiments, the foot operated controls can include joysticks or levers. Embodiments of the foot operated controls can operate the support frame or bucket, and features of the aerial lift. Operation of embodiments of the foot operated controls is shown in the drawings. The foot operated controls can allow the full range of movement, including raise/lower, left/right and boom extend/retract functions. Hand controls can also be included, and an embodiment is shown in the drawings, for controlling operation of the support frame or bucket, and features of the aerial lift. In some embodiments, the chest support can be included on an elongated padded member that can extend from the operator's chest to below the knees, and has a recess that is shaped to accept and engage the operator's knees in a bent manner. The recess can be shaped to allow the knees to grip the recess and provide stability to the operator when working. In some embodiments, the seat can have a back support and a safety retaining bar or member having an chest support which can be integral therewith. When the operator is securely seated, the safety retaining bar can be moved, such as by pivoting into contact with the front of the operator's body and locked in place to ensure that the operator does not fall out of the seat. The chest support can provide a stable work or support surface to support the operator's weight and upper body.

BRIEF DESCRIPTION OF THE DRAWINGS

The patent or application file contains at least one drawing executed in color. Copies of this patent or patent application publication with color drawings will be provided by the Office upon request and payment of the necessary fee.

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1:
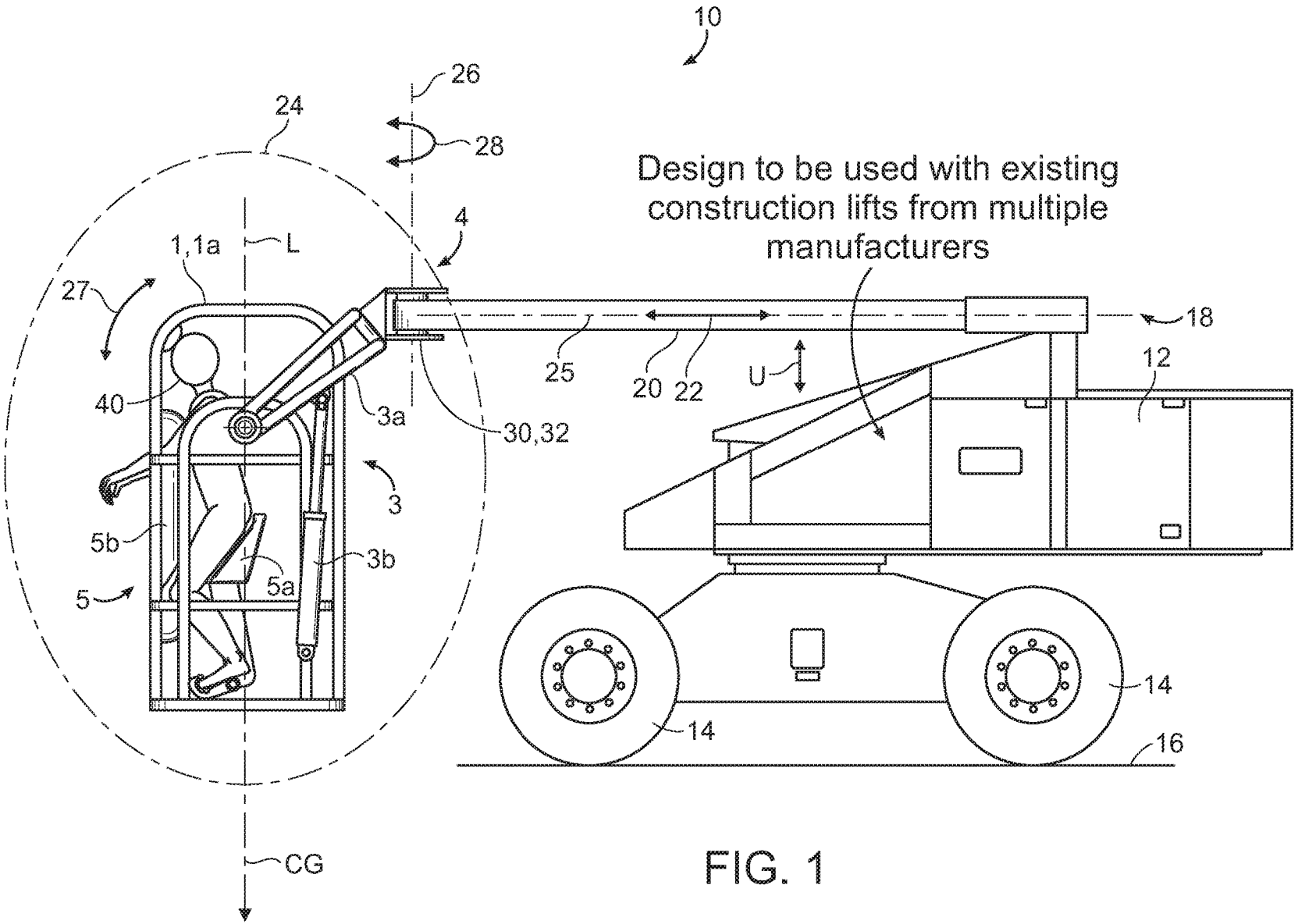
FIG. 1 is a side view of a tilting work or operator support frame, platform, bucket, enclosure, cage, apparatus or assembly in the present invention on an aerial lift.

A description of example embodiments follows.

A tilting work or operator platform, support frame, enclosure, cage, apparatus, assembly or "operator bucket" in the present invention can be used with readily available powered construction aerial lifts. The present invention can have a design to make working on inclined, non-flat surfaces safer and more efficient.

In the prior art, working on inclined surfaces like sloped residential roofs, curved airplane bodies and utility wires is both dangerous and physically challenging. This type of work environment often involves climbing ladders and has a high potential for slip and fall injuries, even death. Work on inclined surfaces also strains worker's bodies due to difficult positions for which the human body is not well adapted. The difficult positions associated with inclined surfaces are physically demanding and result in worker fatigue, further increasing dangers. Setting up safety and fall protection equipment is time consuming; as a result, workers often forgo required protection, resulting in greater risks.

Battery and engine powered aerial lifts as known in the art are being widely adopted and used in the building construction and inspection industries. Available lifts are designed for work on vertical surfaces, for example installing a window in the side of a building. When using existing construction lifts, workers or operators stand up-right, on a work platform that is often called an "Operator Bucket". The upright position that operators are limited to, often does not allow for getting close enough to surfaces to enable natural movement. Also, the need to control the lift with the operator's hands restricts the range of motion and dexterity of the operator. For most tasks on inclined surfaces like roofs, lack of access from lifts and the fact that existing designs often restrict the operators range of motion, often necessitates using ladders or getting out of lifts and standing on the inclined surface in order to complete tasks like installing solar panels and roof shingles or inspecting the exteriors of airplanes. Working on roofs and inclined surfaces can be slippery, exposing workers to high temperatures during summer weather when roofs are hot, resulting in rapid fatigue and body strain. All of these challenges result in high potential for injuries and reduces worker productivity.

Existing aerial lift designs do not comply with the unique needs associated with conducting work on inclined surfaces like sloped residential roofs. Existing designs keep the work platform level and the "operator bucket" in the up-right position. Typically with existing lifts, the bottom of the bucket of the lift comes in contact with inclined work surfaces before the operator is close enough to reach tasks with the arms and hands. Operators would be at increased risk of falling out of the "operator bucket" if the system allowed tilting. Because of this increased risk of falls, existing lifts do not allow for tilting. The controls on most lifts are activated with the operator's hands. The need to use hands to move and position the lift prevents the use of the operators' hands for use in other activities or necessitates alternating between using the controls and doing tasks.

Some of the components in the present invention are listed as follows.

1. Work Platform or "Operator Bucket" 1
2. Pivot Point Assembly 2
3. Yoke and Control Piston Assembly 3
4. Connection Hardware 4. This component can be customized for use and compatibility with specific lifts from different manufacturers.
5. Operator Seat and Chest Support System 5
6. Foot Controls 6

Figure 2:
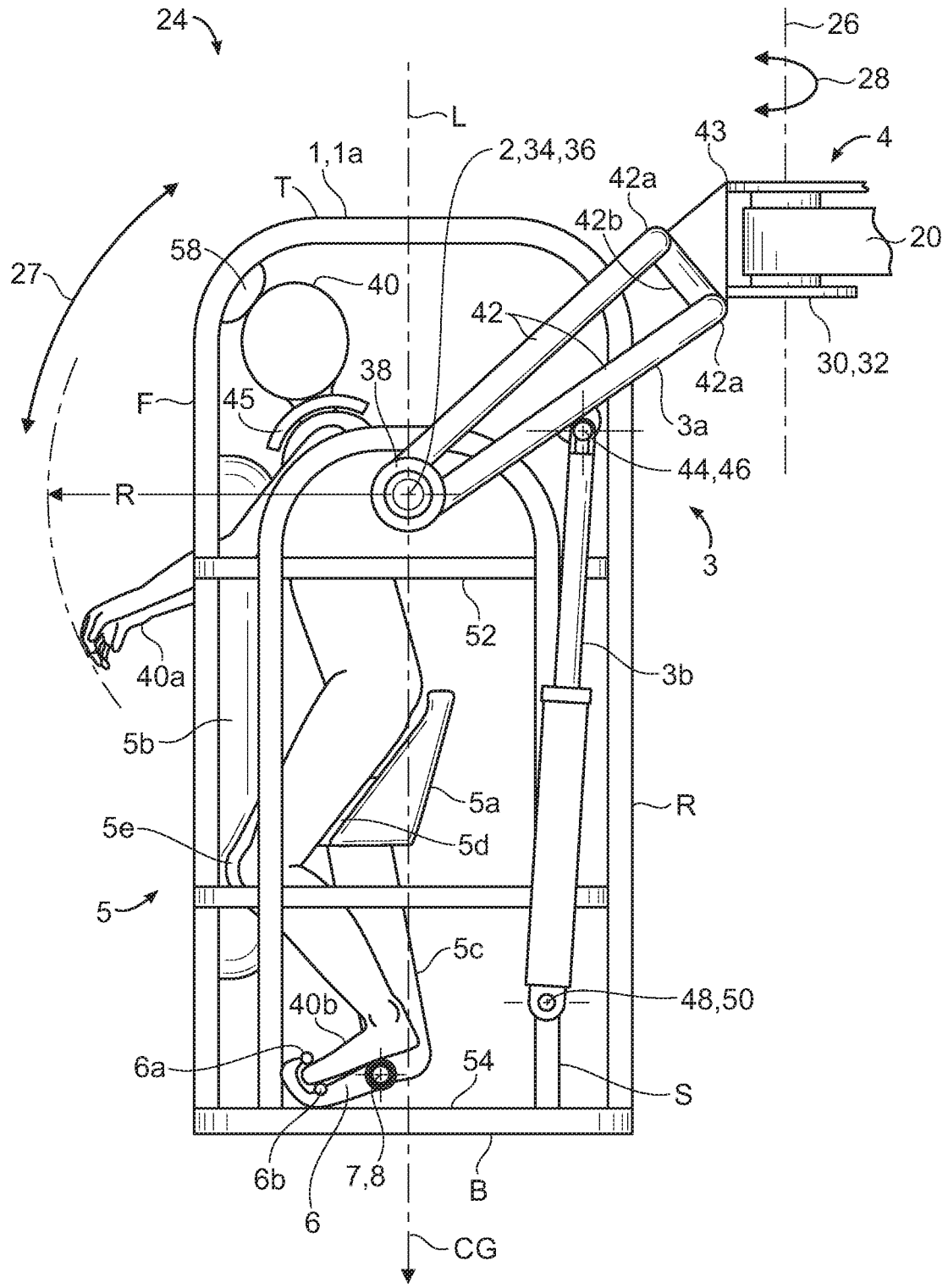
FIG. 2 is an enlarged side view of the tilting apparatus.
Figure 3:
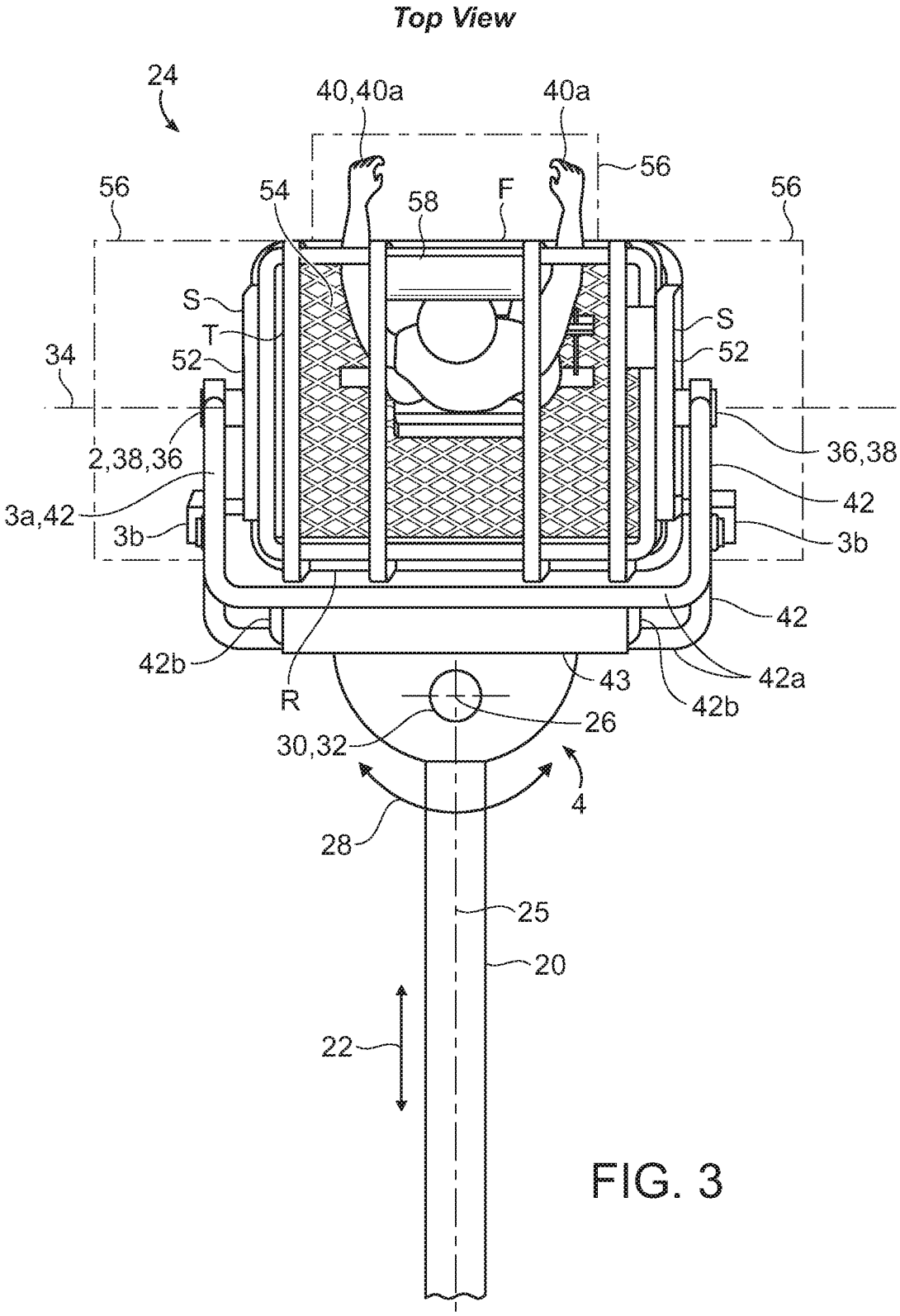
FIG. 3 is a top view of the tilting apparatus.

Referring to FIGS. 1-3, the present invention can include a tilting work or operator support frame, platform, bucket, enclosure, cage, assembly or apparatus 1 in a construction aerial lift 12 which enables safer and more efficient work on inclined surfaces like the roofs of residential homes. The operator work platform 1 can attach to multiple widely available powered construction aerial lifts 12 that are readily manufactured and available for rent. The design allows for controllably tilting the work platform or "operator bucket" 1 and in turn allows the user, worker or operator's body 40 to get close and to match the angle of a sloped roofs. This tilting feature enables better worker positions, less worker fatigue and greater dexterity in using the operator's arms on challenging work surfaces. The design fosters complex work on roofs without the body strain and fatigue that is common with tasks on non-horizontal surfaces. An additional attribute of the bucket 1 is that a second set of controls 6 can be used to move and position the work platform and can be activated with the operator's feet 40*b*. The ability to tilt the operator's body 40 close to work surfaces and the capability to use the feet 40*b* for controlling position, frees the use of the operator's arms 40*a* and enables the operator 40 to have full use of the hands. The tilting feature and foot controls 6 do not adversely impact the stability of the lift system because as the platform 1 tilts, the weight of the operator 40 and items on the platform 1 move closer to the base of the aerial lift 12 for increased stability.

The present invention is well suited for installing roof-mounted equipment like Solar PV systems and roof shingles without walking on or damaging roofing materials. The unique safety features and ease of use of the positioning controls can greatly expand the uses for construction lifts from most major manufactures.

Some advantages of the present invention from the prior art include:

1. The controlled and multi-angle tilting capability of the work platform or "operator bucket" 1 allows workers to get close to inclined work surfaces like roofs without operator fatigue.
2. The tilting function does not impact the stability of the overall lift system. When the system tilts, weight is shifted back towards the lift base and the overall system becomes more stable.
3. The operator can be securely held and supported in a saddle like seat 5*a* and upper body retainer 5*b* that both supports the operator's 40 body and safely secures the operator 40 in the working position to reduce fall risks.
4. The operator 40 is able to move and position the work platform 1 with foot controls 6. The foot controls 6 free the operator's 40 hands for use on complex tasks.

The work platform or "operator bucket" 1 can provide a secure position for workers 40 to both control the lift 12 and to perform tasks on elevated surfaces. The pivot assembly 2 can allow the work platform 1 to tilt to positions that are at an angle and are parallel to inclined surfaces. The yoke and control piston assembly 3 can serve as the connection between the pivot point assembly 2 on the work platform 1 and the connection point on the construction lift 12. The control piston 3*b* and the foot controls 6 that regulate the piston 3*b*, can allow the operator platform 1 to be positioned at angles of tilt to match inclined work surfaces 1. The connection hardware 4 can be customized attachment parts that allow the work platform 1 to be used with the construction lifts 12 from multiple lift manufacturers. Each connection hardware 4 assembly can be specific to the connection needs of each manufacturer and lift 12. The operator seat and chest support system 5 can safely contain the lift operator 40, allows the operator 40 to be comfortably supported in both the up-right, horizontal and a full range of tilted positions, and facilitates the use of the foot controls 6 and arms 40*a*. The foot controls 6 can allow the operator 40 to move and position the work platform 1 without interfering with full use of the operator's arms 40*a*.

The work platform or "Operator Bucket" 1 can be a replacement for the work platforms that are sold with most construction lifts 12. Each unit can be customized to attach directly to widely available construction lifts 12 made by multiple construction lift manufacturers. The work platform 1 can attach to the working end of the boom assembly 20 on many readily available construction lifts 12 via the connection hardware 4. Power for the work platform 1 can come from the standard wiring system that is integral to existing construction lift designs. The work platform 1 can also tie into and communicate with the base system of the construction lift 12 by connecting to the control and communication wiring harness for each existing design. This connection to the base system controls, can allow an operator 40 who is positioned in the work platform 1 to move the base of existing construction lifts 12 around the area surrounding a work site. The interface to the controls also allows the operator 40 to move the operator platform 1 on which the operator 40 is located to different positions relative to the base unit. Specifically, this movement allows the work platform 1 to be elevated to work surfaces and then to move up, across and at angles relative to the work surface. An important design attribute of the work platform 1 is that the controls allow the platform 1 to be tilted to match the angle of inclined surfaces like sloped residential roofs and the profile of airplane bodies. Tilting can be achieved via the pivot point assembly 2, yoke and control piston assembly 3 and foot controls 6. The operator 40 can adjust the foot control 6 lever that regulates tilt. The tilt level foot control can change the length of the control piston 3*b* that is attached to the yoke 3*a*. As the length of the control piston 3*b* changes, the work platform 1 can rotate or tilt inside the yoke 3*a*. The rotation and tilt is changed relative to the center of the pivot point assembly 2. As the work platform 1 rotates or tilts about the pivot point assembly 2, the weight of the operator 40 and any items that are secured to the work platform 1 can move closer to the base unit and improve the stability of the overall lift system. Before the work platform 1 can be tilted, the operator 40 should be securely seated and restrained by the chest support 5*b*. The seat and chest support assembly 5 can keep the operator 40 from falling out of the work platform 1 and enables a comfortable working position for when the work platform 1 is tilted to match the angle of the work surface.

Further details in the present invention now follow. Referring again to FIGS. 1-3, aerial lift system 10 can include a tilting work or operator support frame, platform, bucket, enclosure cage, apparatus or assembly 24 that is secured to the distal end of the boom or boom assembly 20 of an aerial lift 12. The aerial lift 12 can include support and/or locomotion members 14, such as support legs or wheels, which can provide mobility and/or support for the system 10 on the ground 16. The aerial lift 12 can include a lift mechanism, assembly or device 18 which can be raised and lowered in the direction of arrows U. The lift mechanism 18 can include an elongate boom or boom assembly 20, in which the boom 20 extends along a central axis 25 and can extend/retract along axis 25 in the direction of arrows 22. The aerial lift 12 is shown as one style of lift, but it is understood that lift 12 can have other suitable designs for conveying, raising, lowering and positioning the tilting apparatus 24 in desired locations relative to a worksite and work surface.

The tilting apparatus 24 can include a tilting work or operator support frame, platform, bucket, enclosure, cage, apparatus or assembly 1 for enclosing or supporting the worker, user or operator 40. The support frame 1 can be defined or formed by frame members or bars 1*a*, and can have a top T, bottom B, front F, rear R and two sides S, with a generally upright rectangular shape or configuration. Frame members 1*a* can extend to the corners of the support frame 1 and at selected intermediate locations in the vertical and horizontal orientations, with spaces therebetween. The spaces can allow for user entry into the support frame 1 and for the arms 40*a* of the user 40 to extend therefrom to perform work duties. Alternatively, the support frame 1 can have a hinged door for entry by the user 40. Frame members 1*a* can be formed of metallic tubing, such as aluminum, steel or titanium, and can be round or square tubing, and the bottom B can include an expanded metal mesh or diamond tread plate floor 54 (FIG. 3) to support the user 40 when standing on the floor 54.

The operator seat and chest support system 5 can include a saddle type seat having a rear seat portion 5*a*, a front chest pad or support 5*b* forwardly spaced apart therefrom, and a generally horizontal saddle portion 5*d* extending therebetween, which can be secured to the rear seat portion 5*a* and/or the front chest support 5*b*. The front chest support 5*b* can be secured in an upright orientation to the front F of the support frame 1, and include a padded surface. Front chest support 5*b* can extend from below the user's 40 knees to about or above the user's 40 chest. The majority of the front chest support 5*b* above the knees can have a flat padded surface for engaging and supporting the user's 40 chest when the support frame 1 is in a forward angled, inclined or tilted position relative to vertical, facing downwardly, or a horizontal position. The area of the front chest support 5*b* at about the horizontal saddle portion 5*d* in the region of the user's 40 knees, lower thigh and upper shins, can have a leg or knee support such as a knee cavity, indentation or recess 5*e* which can have an upper portion that extends or angles inwardly downwardly and a lower portion that extends outwardly downwardly, forming a narrowing twin angle recess 5*e* that can accommodate and engage the user's 40 lower thighs, knees and upper shins when bent slightly at the knees. A lower limb, leg, post, bracket or stem 5*c* can extend downwardly from the bottom of the rear seat portion 5*a* or saddle portion 5*d*, and can extend rearwardly at a slight angle. Movable pedal or foot controls 6 can be mounted to the lower distal end of the stem 5*c* with a rotary joint 8 about a lateral pedal axis 7 that can extend parallel to the bottom B, front F and rear R of support frame 1. A forehead support or rest 58 can be positioned in the upper front portion of the support frame 1 for engaging the forehead of the user 40. Shoulder retainers or pads 45, which can be curved or arched such as in a U shape, can retain the shoulders to prevent sliding when tilted forwardly.

The user 40 can sit in the operator seat and chest support system 5 between the rear seat portion 5*a* and the front chest support 5*b*, sitting on and with legs straddling the horizontal saddle portion 5*d*. The users 40 legs can be bent at the knee and the knees inserted into the recess 5*e* of the front chest support 5*b*. The user's feet 40*b* can be inserted between the upper 6*a* and the lower 6*b* pedal surfaces of selected pedals 6*c* of the foot controls 6. When the support frame 1 is tilted from the upright direction into a forwardly downward tilted positioned as indicated by arrows 27, the user 40 can rest his forehead against the forehead rest 58 at the front F, his chest against the front chest support 5*b*, and his knees engaged against the knee recess 5*e* in the front chest support 5*b*. As a result, the weight of the forwardly downward tilted user 40 can be distributed and supported at multiple rest points, the buttocks on the saddle portion 5*d*, the forehead on the forehead rest 58, the chest on the front chest support 5*b* and the two knees at the knee recess 5*e* of the front chest support 5*b*. The multiple rest points for the user 40 when in a tilted position allow the user to work comfortably for extended periods of time with less fatigue since energy does not have to be expended to hold the body in a work position. The multiple rest points also puts less stress on each part the user's 40 body that engages a rest point, which can be important when the user 40 is lifting or moving heavy objects with his arms 40*a*. Portions of the seat and chest support system 5 can be adjustable for user comfort.

The angled shape of the knee recess 5*e*, as well as its relationship to the saddle portion 5*d* can also allow the user 40 to use his legs and knees to maintain a position within the operator seat and chest support system 5 while tilting and/or working on an inclined surface. It can be important that the user 40 maintain a fixed position within the system 5 when lifting and installing roof or solar components for precision work as well as for preventing accidents and injury. In some positions, the user 40 may press his knees and/or upper shins against the lower angled portion of the knee recess 5*e*, and in other positions, press his knees and/or thighs upwardly against the upper angled portion of the recess 5*e*, which in turn can press the buttocks downwardly against saddle portion 5*d* and rear seat portion 5*a*, locking the thighs and buttocks between two generally opposed surfaces. These can help control or maintain the body position of the user 40 in certain positions or while performing certain duties. The user 40 may also squeeze opposite sides of the saddle portion 5*d* with his thighs to maintain position. The twin angled recess of the knee recess 5*e* also allows the user 40 in some embodiments to tilt downwardly past the horizontal position, with the head facing downwardly while maintaining fixed or desired body positioning or stability. In some embodiments, the knee recess 5*e* can be replaced with separate thigh pads, knee pads, and shin pads, or padded bars, that are positioned in a similar orientation as knee recess 5*e*. In some embodiments, the leg or knee support can be an adjustable hammock assembly which can have adjustable straps, that can support the user's 40 knees while allowing easy adjustment.

The two sides S of the support frame 1 can each have side pivot plates 52 fixed to the frame members 1*a* on the opposite sides S. The side plates 52 can be rotatably connected by the pivot point assembly 2 to the yoke and control piston assembly 3 about a lateral or horizontal axis 34 with a pair of rotary joints 36. Axis 34 can extend through the sides S parallel to the bottom B, and can intersect a central longitudinal axis L of the support frame 1 above the saddle portion 5*d* to be centered in the sides S in the upper portion of the support frame 1 in the region of the users 40 shoulder or shoulder joint. Axis 34 and rotary joints 36 can be positioned at a vertical height location that is above the center of gravity CG which can be more than ½ the vertical height of the support frame 1, for example above ⅔ the height of the support frame 1 such as 70% the height. In some embodiments, the center of gravity CG is at about ½ the vertical height of the support frame 1. The yoke and control piston assembly 3 can have a pivotable or rotatable support link, member, portion or yoke 3*a* having side yoke members 42 that are rotatably connected to the side plates 52 with the two rotary joints 36. Each side of the yoke 3*a* can have two side yoke members 42 formed of tubing or bars that are spaced apart and connected to a rotary joint 36 at the distal ends, and connected together at the proximal ends by crossbars or members 42*a* which can be formed of the same material. The side yoke members 42 can be on the outside of side plates 52 and sides S, and the cross members 42*a* can extend around the rear R of support frame 1. The cross members 42*a* in turn can be secured together by stiffening bars or members 42*b*. The yoke and control piston assembly 3 can further include at least one actuating device or fluid piston 36 such as a hydraulic or pneumatic cylinder. FIG. 3 shows one cylinder 3*b* on each side S. The cylinder body of a cylinder 3*b* can be rotatably attached to a frame member 1*a* on a side S by a rotatable joint 48 about a lateral or horizontal axis 50, and the cylinder or piston rod can be rotatably attached to a side yoke member 42 by a rotatable joint 44 about a lateral or horizontal axis 46 that is spaced apart from lateral axis 34 and rotary joints 36. Operation of cylinder 3*b* (extend/contract) can pivot or rotate support frame 1 between an upright position and desired tilted or rotated positions in the direction of arrows 27, such as forwardly downward facing tilted positions relative to vertical, including horizontal or in some embodiments downwardly tilted positions beyond horizontal, for certain yoke 3*a* designs. In some embodiments, the cylinder(s) 3*b* can be replaced with electric linear actuators or a rotary actuator(s) 38 which can be fluidly, hydraulically or pneumatically operated, or can be a motor such as a fluid, hydraulic of electric motor, and positioned at about a rotary joint 36. One or two rotary actuators 38 can be employed. By having the axis 34 of rotation for tilting in the direction of arrows 27 approximately at the location of the user's 40 shoulder joint or above the center of gravity CG, the radius of rotation R about axis 34 relative to the users arm's 40*a* can be close enough so that the support frame 1 can be rotated while the arms 40*a* can remain about the same distance from work surface, which can make work activities easier while adjusting position and for maximum reach. In some embodiments, only one rotary joint 36 on one side S can be used to pivot support frame 1.

The yoke 3*a* can be secured to the boom 20 of the aerial lift 12 with connection hardware 4. The connection hardware 4 can include an adapter, bracket or fixture 42 secured to the yoke 3*a*, such as to cross members 42*a*, that is rotatably coupled to a rotary joint 30 extending along an upright or upwardly extending axis 26 at the distal end of the boom 20. An actuating device or actuator 32 such as described for cylinder 3*b* or rotary actuator 38 can be positioned at joint 30 for rotating the joint 30. Rotary joint 30 allow side to side rotary movement of the support frame 1 about axis 26 in the direction of arrows 28, to pivot or rotate the support frame 1 side to side. In view that each aerial lift 12 and/or boom 20 can be different in various lifts, connection hardware 4 can be different for different lifts.

Referring to FIG. 3, at least one accessory attachment carrying device 56 such as a rack, container, platform or basket can be attached to the support frame 1 for carrying supplies, materials and tools for conducting work. Supplies and materials can include shingles, plywood, insulation, boards, rafters and solar panels for roofs. Two carrying devices 56 are schematically shown in FIG. 3 on the sides S and one on the front F, but other locations and number of carrying devices 56 can be employed. Various different carrying devices 56 can be attached and used that can be designed specific to the items being held and carried, and for easy access by the user 40.

Figure 4:
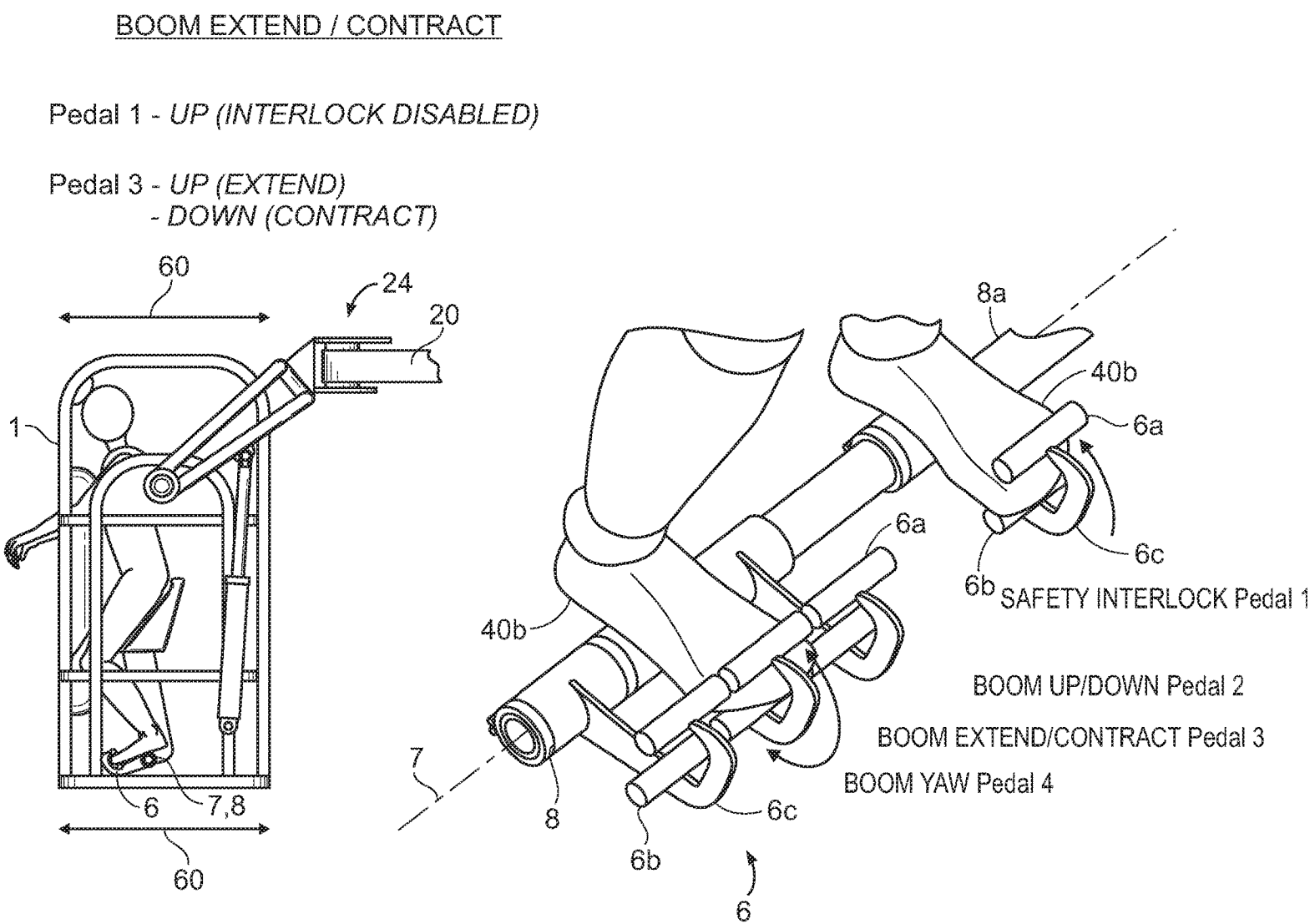
FIGS. 4 and 5 are side views of the tilting apparatus in conjunction with a projected detailed view of an embodiment of foot controls showing movement of the tilting apparatus related to selected foot controls.

Referring to FIG. 4, an embodiment of the foot controls 6 can include a series of pedals 1-4, for operation with the user's feet 40*b*, that can be electrically connected to a controller 76 by line 82 (FIG. 11) for operating the aerial lift system 10 via line 90. Each pedal 1-4 can include a pedal or pedal member 6*c* that is rotatably mounted about a shaft 8*a* with a rotary joint 8 for rotation about a lateral pedal axis 7. Each pedal member 6*c* can have an upper pedal member, surface or bar 6*a* and a lower pedal member, surface or bar 6*b* between which the instep and/or toes of the user's feet 40*b* can be inserted for pivoting or rotating the pedal member 6*c* upwardly or downwardly as desired. In the embodiment shown in FIG. 4, pedal 1 can be associated with the users 40 left foot 40*b*, and pedals 2-4 can be associated with the right foot 40*b*. Pedal 1 can be safety pedal interlock, disabling in the up position, pedal 2 with up/down positions can control respective up/down movement of the boom 20, pedal 3 with up/down positions can control respective extend/contract movement of boom 20, and pedal 4 with up/down positions can control respective left/right yaw movement of the support frame 1 relative to the boom 20. Alternatively or additionally, pedal 4 can be used control respective left/right yaw movement of the boom 20 itself. FIG. 4 depicts a manner to extend and contract boom 20 with the foot controls 6. Pedal 1 can be moved in the up position where the pedal interlock is disabled, wherein moving pedal 3 in the up position can extend the boom 20, and moving pedal 3 in the down position can contract the boom 20, resulting in movement of the support frame 1 and tilting apparatus 24 in the direction of arrows 60.

Figure 5:
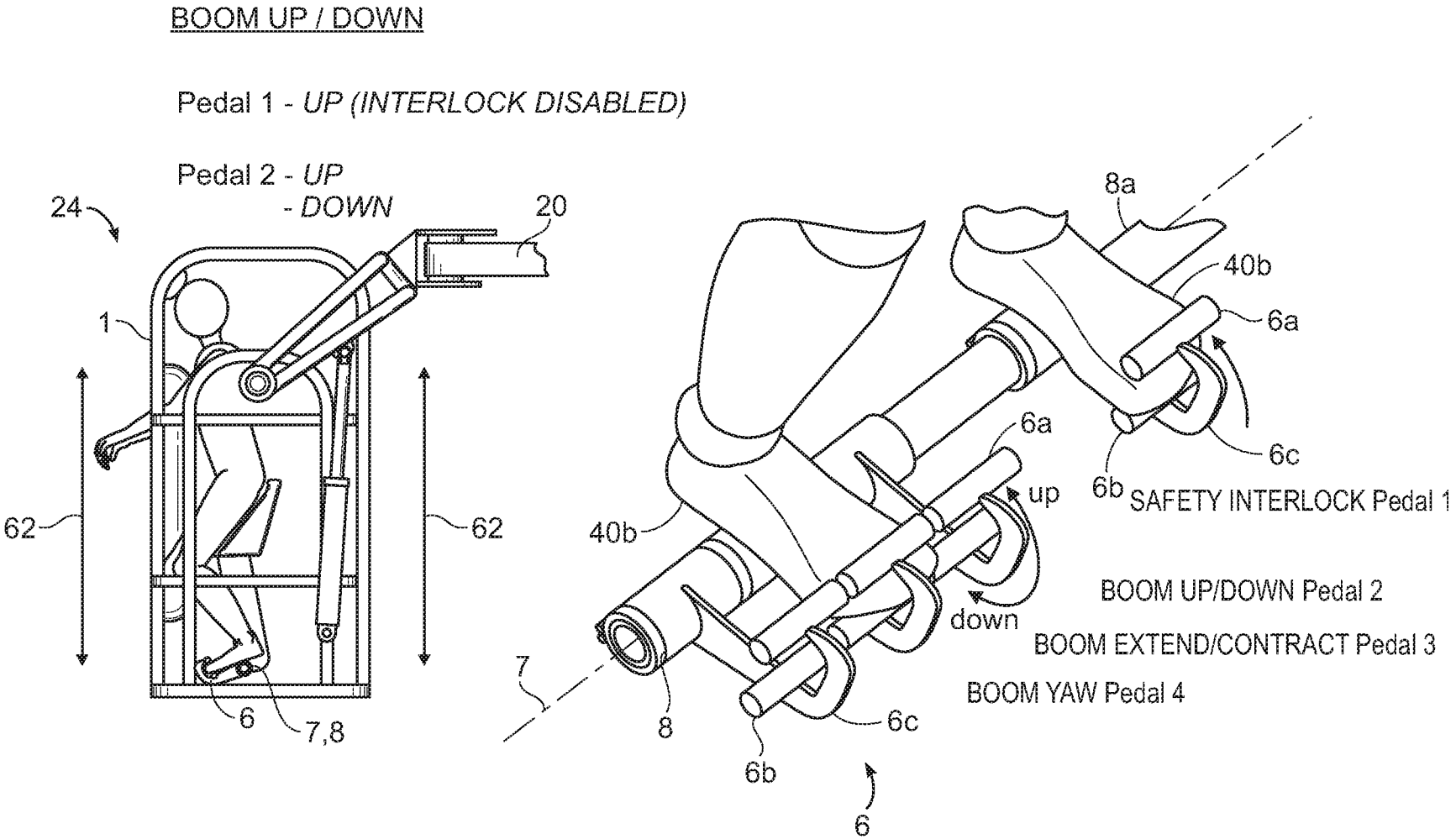

FIG. 5 depicts a manner to move the boom 20 up-and-down with foot controls 6. Pedal 1 can be moved in the up position to disable the pedal interlock, and pedal 2 can be moved either in the up or down position to move the boom 20 up or down, respectively, resulting in the movement of the support frame 1 and tilting apparatus 24 in the direction of arrows 62.

Figure 6:
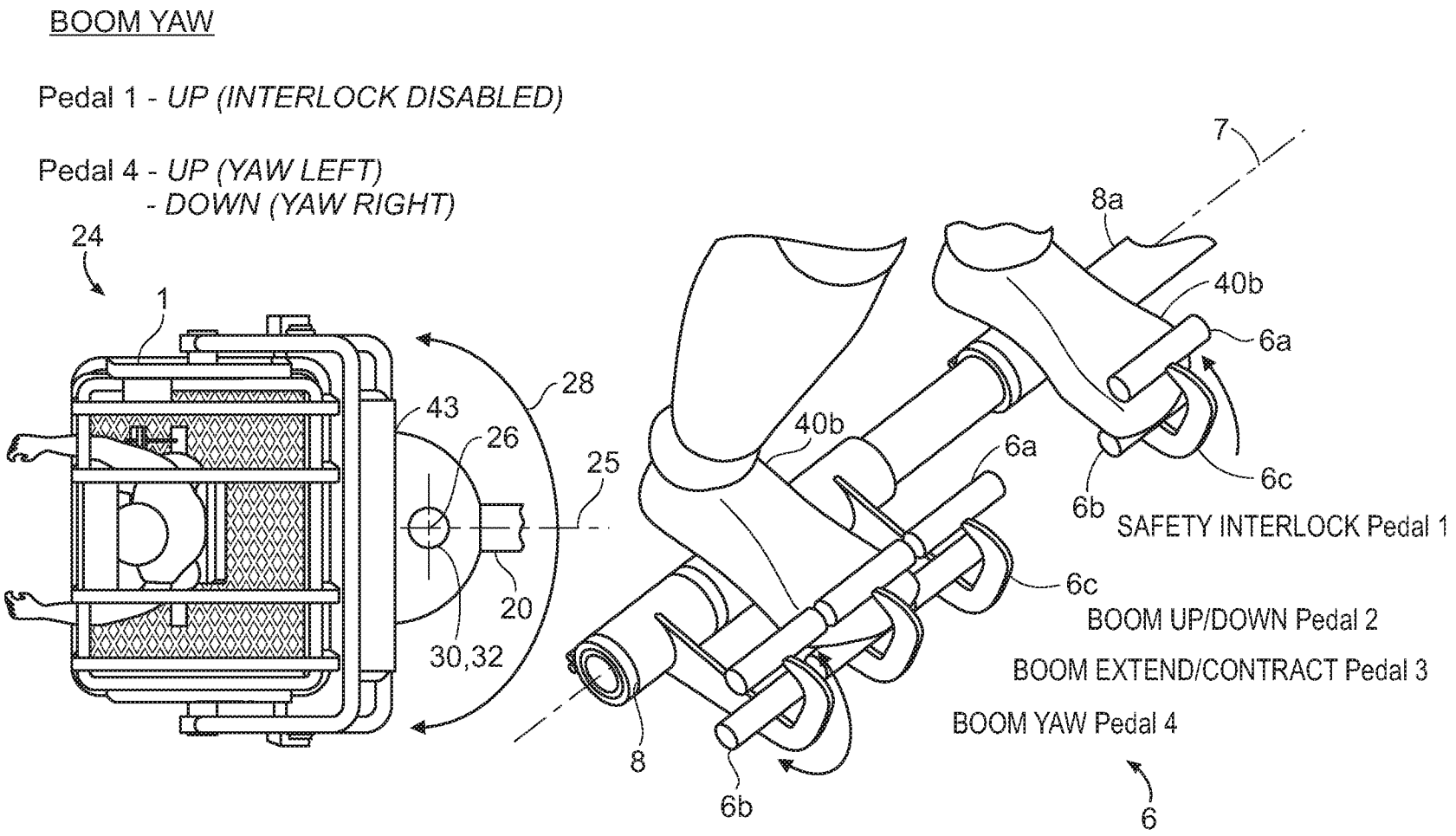
FIG. 6 is a top view of the tilting apparatus in conjunction with a projected detail view of the foot controls showing movement of the tilting apparatus relative to selected foot controls.

FIG. 6 depicts a manner to move the tilting apparatus 24 and support frame 1 and/or the boom 20 to yaw left or yaw right with foot controls 6. Pedal 1 can be moved in the up position to disable the pedal interlock, and pedal 4 can be moved either in the up or down position to move the support frame 1 and tilting assembly 24 and/or the boom 20 in the yaw left or yaw right directions respectively, as indicated by the arrows 28. Another pedal 5 or a fifth function can be provided for tilting the support frame 1 forwardly.

Figure 7:
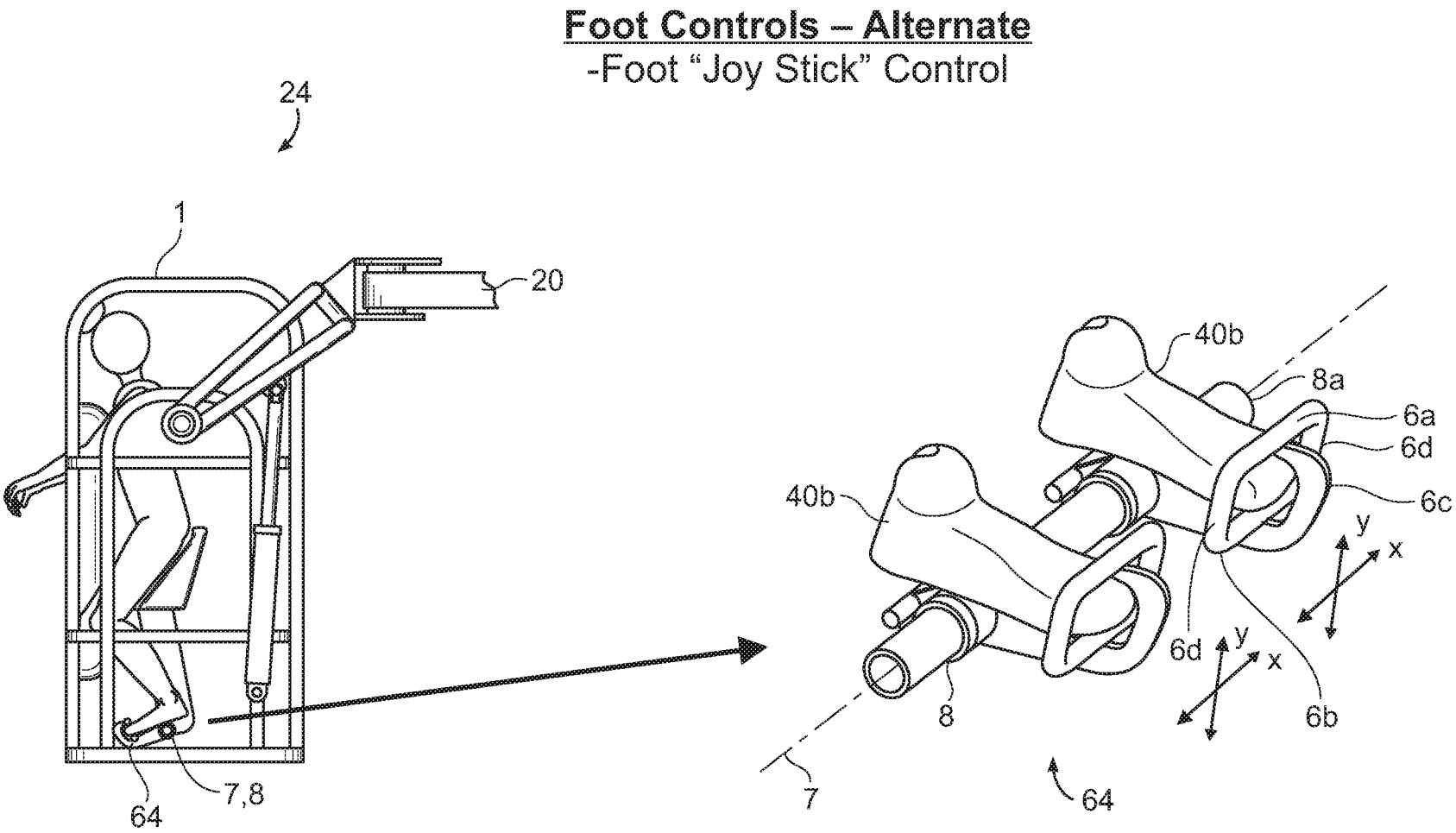
FIG. 7 is a side view of the tilting apparatus in conjunction with a projected detail view of another embodiment of foot controls showing movement of the tilting apparatus related to selected foot controls.

FIG. 7 depicts another embodiment of foot controls 64 that can be electrically connected to controller 76 by line 82 (FIG. 11) which differs from foot controls 6 in that each foot 40*b* controls a single pedal member 6*c*, where the upper 6*a* and lower 6*d* pedal members are connected together by left and right pedal members, surfaces or bars 6*d*. As a result, the user's feet 40*b* can engage the upper 6*a*, lower 6*b* and left/right 6*d* pedal bars to move the pedal members 6*c* in the +/−X-Y directions. Operation of the left foot pedal can be the same as in foot control 6, and operation of the right foot pedal can have a left position comparable the pedal 2 for boom up/down, a center position comparable to pedal 3 for boom extend/contract, and a right position comparable to pedal 4 for boom/yaw, and if desired, another position comparable to a pedal 5 or a fifth pedal function for tilting of the support frame 1 forwardly. The pedals 6*c* in foot controls 64 can act as foot joysticks.

Figure 8:
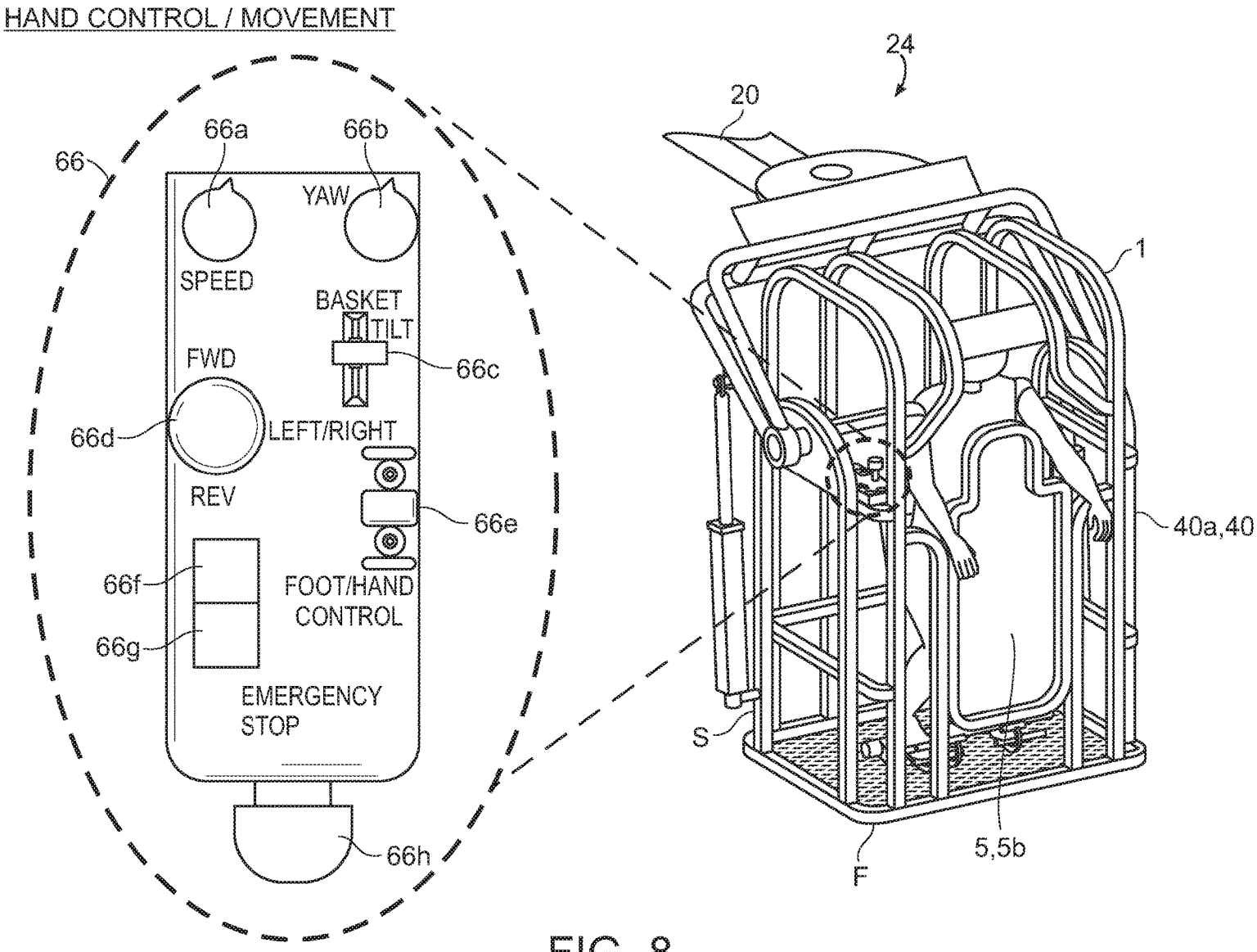
FIG. 8 is a front perspective view of an embodiment of a tilting apparatus with an enlarged detail of an embodiment of hand controls.
Figure 9:
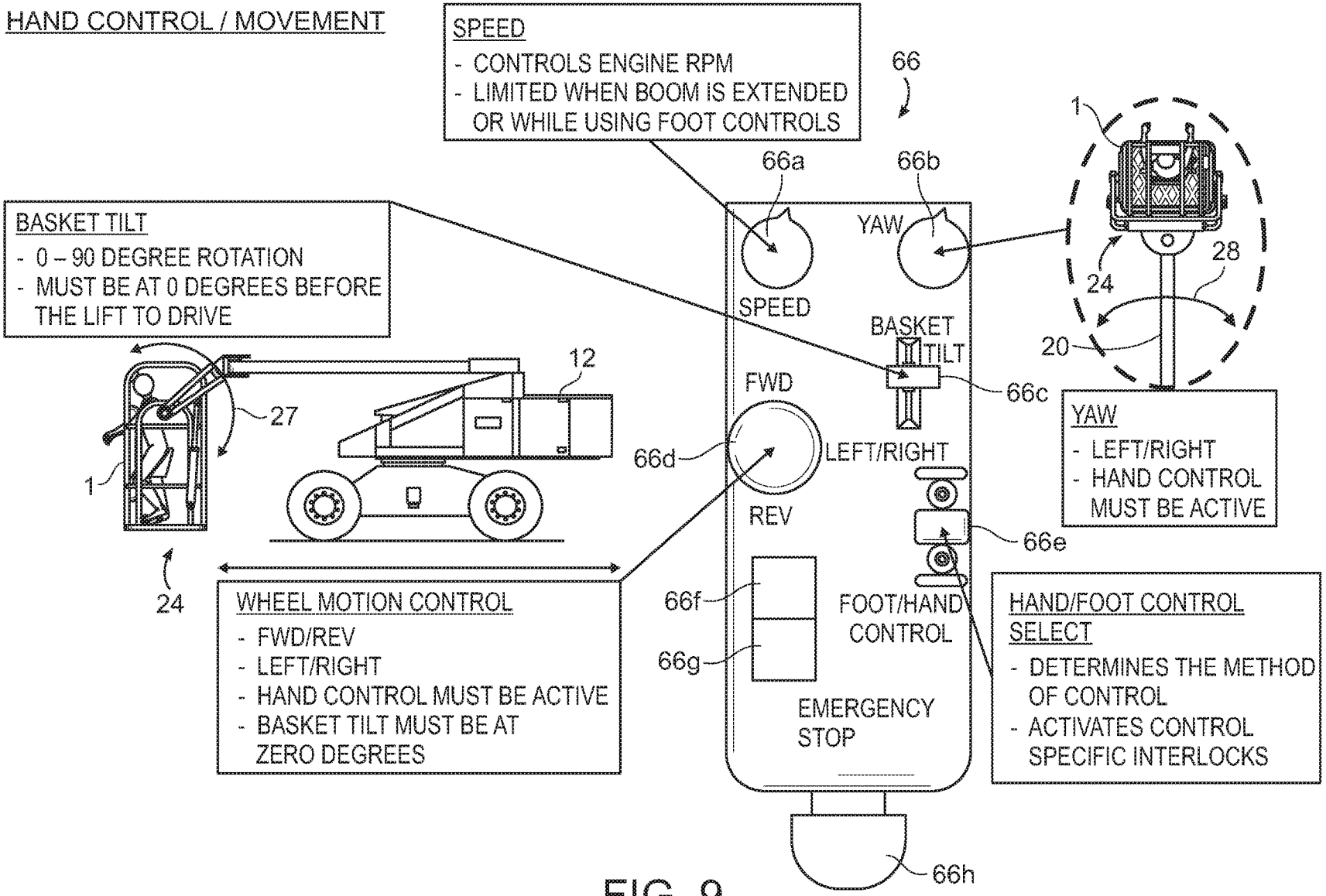
FIG. 9 is a schematic drawing showing the relation of the hand controls of FIG. 8 to movement of the tilting apparatus.

FIGS. 8 and 9 depict hand controls 66 that can be a second set of controls that are electrically connected to controller 76 by line 82 (FIG. 11) and included on the front F, right sides S of the support frame 1 to allow the user 40 to control aerial lift system 10, aerial lift 12 and tilting apparatus 24 with the hands via controller 76 and line 90. The hand controls 66 can include a foot/hand control button or switch 66*e* to select between using the hand controls 66 and the foot controls 6 or 64, as well as to activate specific interlocks. Switch or lever 66*c* can control or select the amount of tilt and/or direction that support frame 1 is tilted, rotated or pivoted in the direction of arrows 27. In the embodiment shown, 0 to 90° rotation is available, and the support frame 1 must be upright or vertical at 0° for aerial lift 12 to be driven on a worksite. Button or switch 66*b* can control the amount of right/left yaw that the support frame 1 and/or boom 20 is moved. Button or switch 66*d* can control forward, reverse, left and right movement of the lift 12. Button or switch 66*f* can be electrically connected to controller 76 by line 84 (FIG. 11) and can be a return to a desired tilt angle memory function stored in controller 76 where with the push of one button, the support frame 1 can be returned or tilted automatically to a specific predetermined or stored angle or inclination over a specific work surface such as the roof 68 in FIG. 10, thereby increasing work efficiency. Button or switch 66*g* can also be electrically connected to controller 76 by line 84 and can be a return to location memory function stored in controller 76 where with the push of one button, the support frame 1 can be moved from one predetermined location to another predetermined location, for example a roof 68, such as between the positions shown in FIGS. 1 and 10. This can be for example to return to a loading zone on the ground 16 for conveying work materials from the loading zone to a work surface with speed and efficiency. Button or switch 66*a* can control the speed of the aerial lift 12, for example by controlling the engine RPM or the speed of the hydraulic pump motor, or position of a proportional flow regulating valve. Control can be limited when boom 20 is extended or when using foot controls 6. Button or switch 66*h* can be an emergency stop button to stop operation of aerial/lift system 10. The functions between the foot controls 6/64 and hand controls 66 can vary, depending upon the needs of the user, the lift 12, or the job function. In some embodiments, the functions can be the same or overlapping, and in other embodiments, some functions can be specific to being on the foot controls 6/64 and hand controls 66.

Figure 10:
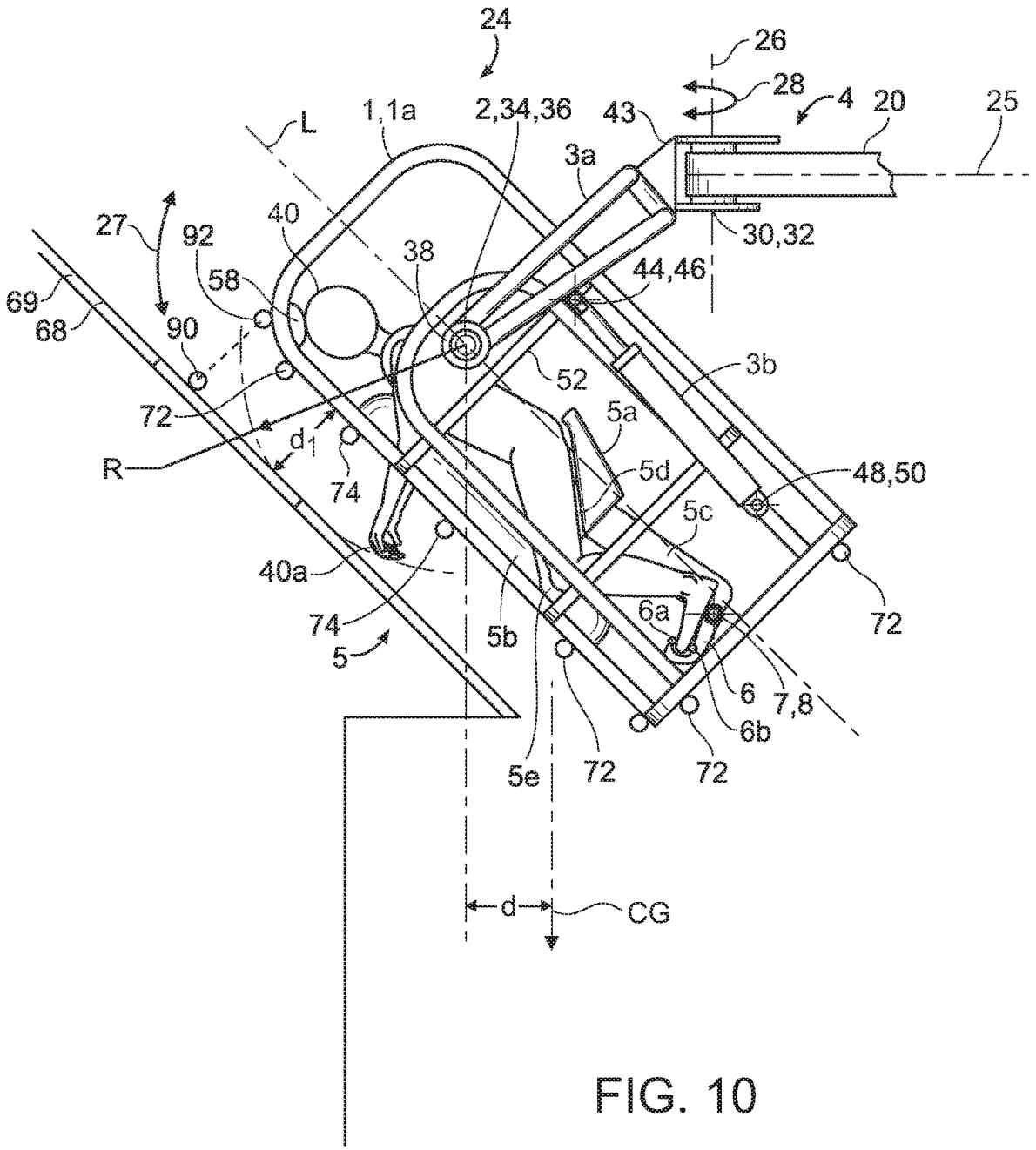
FIG. 10 is a side view showing an embodiment of the tilting apparatus tilted forwardly over a roof.

Referring to FIG. 10, the user 40 has positioned the support frame 1 in a 45° forwardly downward tilted position or orientation over a 45° angled work surface or roof 68 of a building. To position the support frame 1 in such a location and orientation, the user 40 can either drive the aerial lift system 10 manually into position with the hand controls 66 or in some embodiments foot controls 6/64, and manually position and orient the support frame 1, or alternatively can use the return to location function button 66*g* and the return to desired tilt angle function button 66*f* to quickly move aerial lift system 10 from the position shown in FIG. 1 to the position and orientation shown in FIG. 10. As can be seen in FIG. 2, when the support frame 1 is in the upright position, the center of gravity CG of the support frame 1 generally extends vertically downward along the longitudinal axis L of the support frame 1 and intersecting axis 34 of the rotary joints 36 where support frame 1 pivots relative to yoke 3*a*. As the support frame 1 is tilted forwardly relative to vertical to the position shown in FIG. 10, since the rotary joints 36 are positioned in the upper portion of the support frame 1 above the center of gravity CG (for example at 70% the height of the support frame 1), as the support frame 1 rotates, tilts or pivots forwardly about the rotary joints 36, the height of the support frame 1 below the rotary joints 36 swings, pivots or rotates rearwardly toward the boom 20, and the center of gravity CG of the support frame 1 also moves rearwardly toward the yoke 3*a*, the boom 20 and the aerial lift 12, thereby increasing stability of aerial lift system 10. FIG. 10 depicts that the center of gravity CG has moved an offset distance d away from the former upright position of the center of gravity CG that passed through axis 34, and is now closer to boom 20, after the support frame 1 is tilted.

Figure 11:
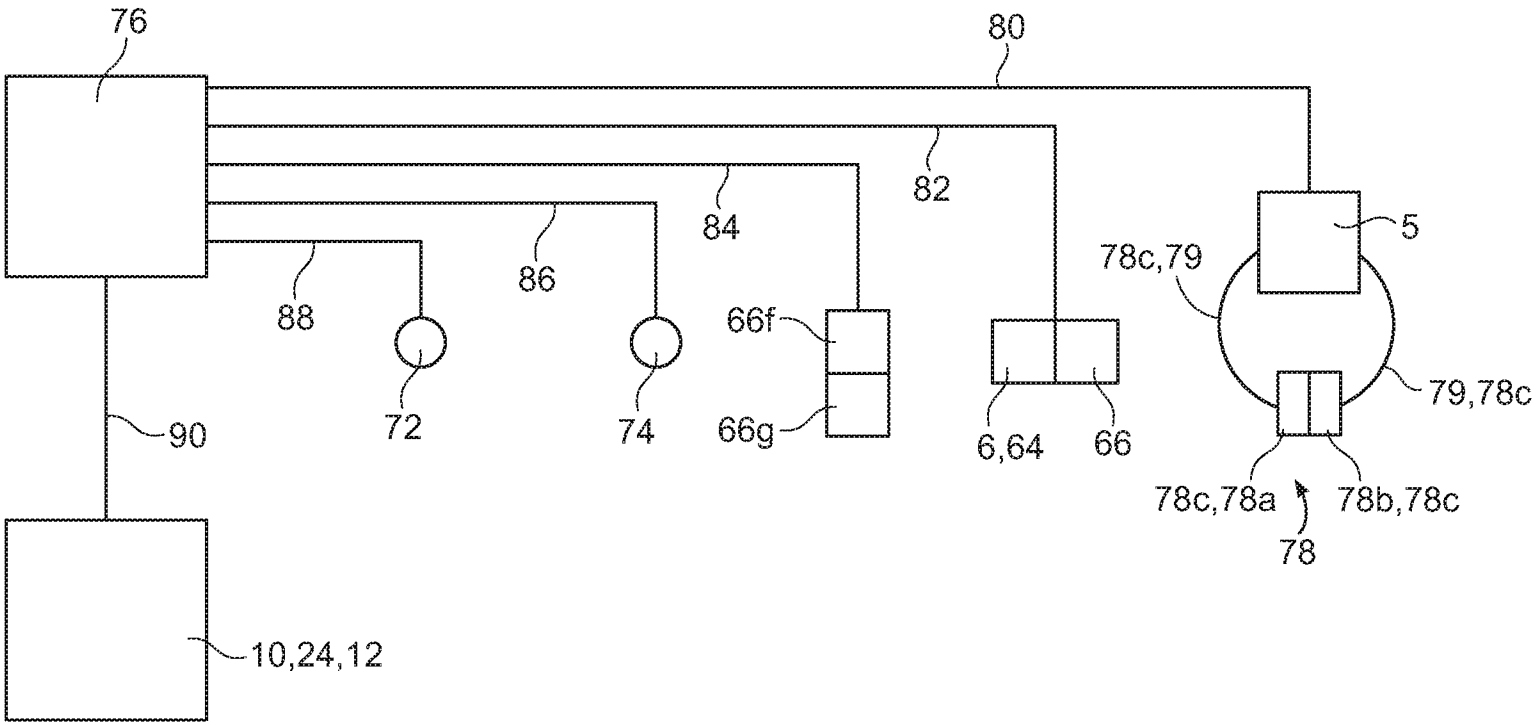
FIG. 11 is a schematic drawing of an embodiment of a control arrangement for the tilting apparatus.

A series of proximity sensors 72 can be positioned on the front F and/or bottom B of the support frame 1 and can be electrically connected to controller 76 by line 88 (FIG. 11). Controller 76 can be also electrically connected to the foot controls 6 or 64, the hand controls 66 and aerial lift system 10, including the aerial lift 12 and tilting apparatus 24. The proximity sensors 72 can be chosen, programmed, set or adjusted to only allow certain surfaces of the support frame 1 to be moved within a predetermined set distance d1 from the work surface or roof 68 to aid in keeping a consistent offset or distance d1 between exterior parts of the support frame 1 and the work surface 68, so as to prevent damage to components on the work surface 68, for example solar panels 69. The controller 76 can be programmed in conjunction with the proximity sensors 72 to set and store a predetermined distance d1 that is best for the length of the arms 40*a* of multiple predetermined users 40 and the work preferences. The hand controls 66 can have an adjustable function to adjust how close the support frame 1 gets to the work surface 68 before it slows down or stops and prevents collision therewith.

The front F of the support frame 1 can have safety or "break" sensors 74 that can be electrically connected to the controller 76 by line 86 (FIG. 11), and positioned on the frame members 1*a* for sensing the presence of the arms 40*a* of the user 40 between outside structures such as the work surface 68 and the exterior front F of the support frame 1 during movement of the support frame 1 and tilting apparatus 24. In some embodiments, the break sensors can be proximity, laser or optical sensors, or cameras. The break sensors 74 can stop movements such as forward movement of the support frame 1 and tilting apparatus 24 to prevent pinching injuries to the user's 40 arms 40*a*. Alternatively, sensors 72 and/or 74 can be replaced with shells or bumpers 90 (FIG. 10) such as formed from rubber or plastic extending from the front F and/or bottom B of the support frame 1 with a spring-loaded safety shutoff switch 92 so that engagement with an outside structure can stop operation or movement of aerial lift system 10 or tilting apparatus 24 to prevent damage to the work surface or injury to the user's 40 arms 40*a*.

Referring to FIG. 11, the operator seat and chest support system 5 can include a seatbelt and/or chest harness 78 with a safety system for restraining the user 40 within the seat 5*a*/5*d* and preventing operation of the aerial lift system 10, aerial lift 12 and/or tilting apparatus 24 if the seatbelt and/or chest harness 78 is not secured. The harness 78 can include restraints or straps 79 that can be latched together by respective mating latches 78*a* and 78*b*. The straps 79 and latches 78*a* and 78*b* can include electrical wiring, circuitry or path 78*c* therein, so that when latches 78*a* and 78*b* are closed, the electrical circuit or path 78*c* through both sides of the strap 79 and latches 78*a* and 78*b* is closed or completed, signaling the controller 76 to allow operation of the lift system 10, aerial lift 12 and/or tilting apparatus 24. The straps 79 can be chest straps for a chest harness and/or seatbelt straps for the waist, and as a safety feature, will not allow operation unless the user 40 is safely secured in place by straps 79. Alternatively, the harness 78 can be replaced with a safety retaining bar which can close and electrical circuit or path 78*c* when locked in place.

Figure 12:
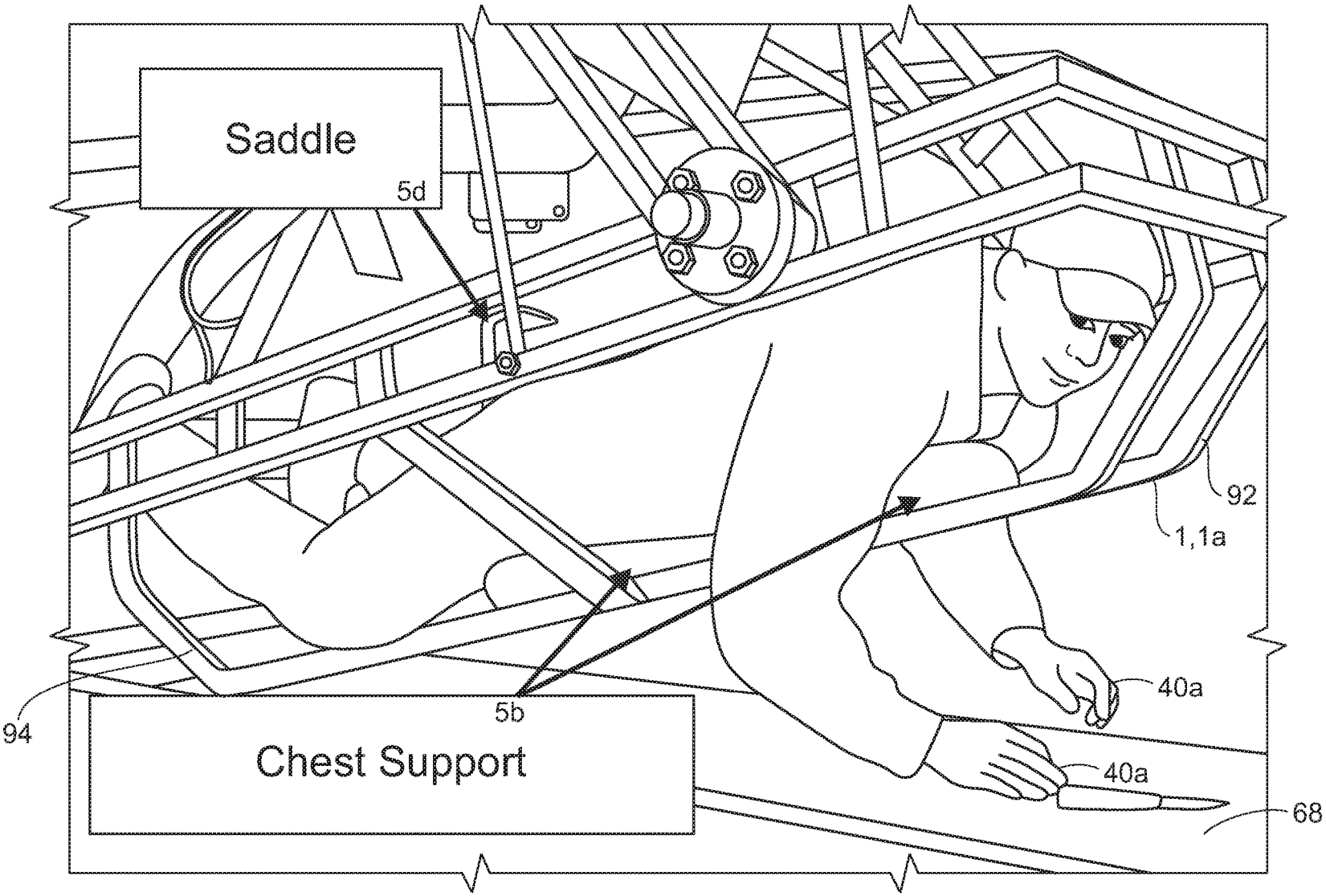
FIG. 12 is a perspective view of a user in another embodiment of a support frame in the present invention.

FIG. 12 depicts another embodiment of a support frame 1 in the present invention, shown tilted about 65° from vertical (25° from horizontal) over a work surface 68, with a user 40 supported by the front chest support 5*b* and the saddle portion 5*d*, with the arms 40*a* extending downwardly onto the work surface 68. The upper front 92 and lower front 94 of the support frame 1 can be recessed, angled, or tapered rearwardly which can reduce or prevent the chance of the upper front 92 and the lower front 94 from getting caught on outside structures such as gutters on a roof when moved or inclined over such structures.

Figure 13:
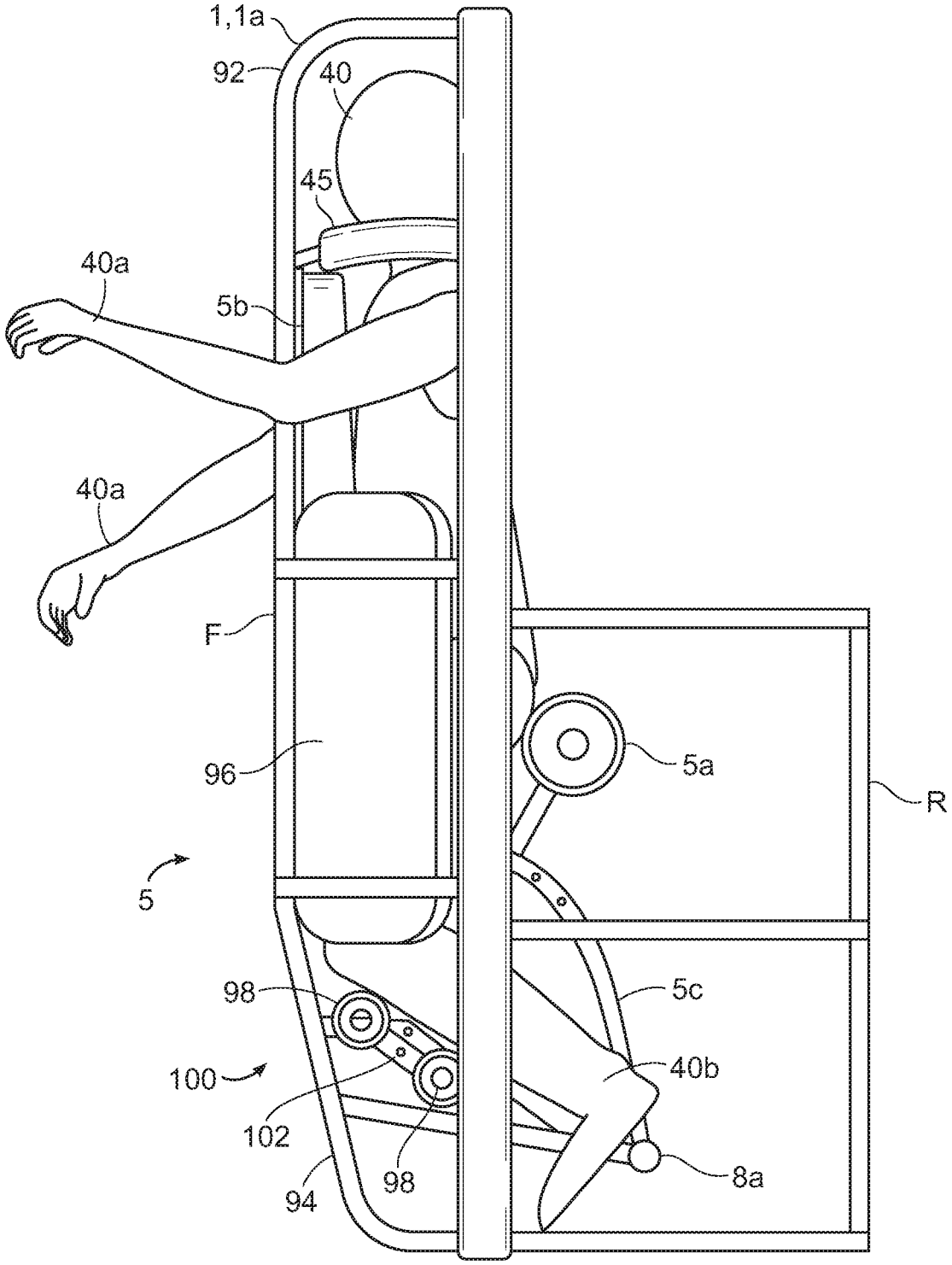
FIGS. 13 and 14 are side and rear perspective views respectively, of another embodiment of a support frame in the present invention.
Figure 14:
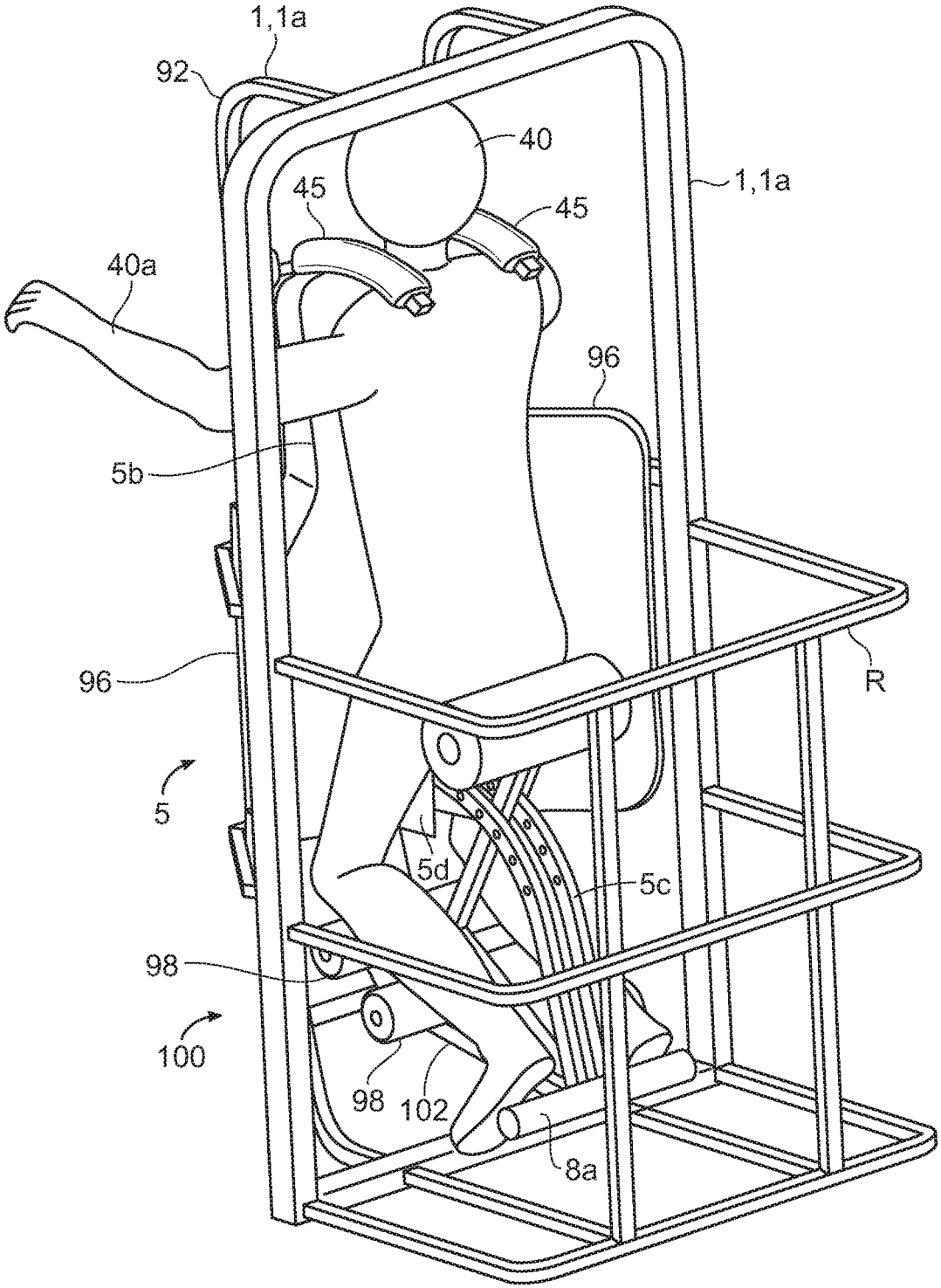

Referring to FIGS. 13 and 14, support frame 1 in another embodiment can have the frame members 1*a* extend only partway or about halfway the vertical height on the rear R portions. The operator seat and chest support assembly 5 can have two rearwardly outwardly angled or inclined opposite right and left padded torso wings or members 96 to help keep the user 40 positioned in place during use. The two shoulder retainers 45 can extend over each shoulder of the user 40. The knee recess 5*e* can be replaced by a leg or knee support assembly having two parallel horizontal padded supports or bars 98 secured to a frame 102 for engaging and supporting the two legs at the knee area (or just below) and the shins. The thighs can engage the lower portion of the front chest support 5*b*. The frame 102 can be secured to the stem 5*c* and the front F of support frame 1. The lower front 94 can be rearwardly tapered, angled or recessed more than the upper front 92.

While example embodiments have been particularly shown and described, it will be understood by those skilled in the art that various changes in form and details may be made therein without departing from the scope of the embodiments encompassed by the appended claims. For example, features described above can be omitted or combined together. It is understood that support frame 1 or bucket can have many different shapes and constructions. For example, the support frame 1 or bucket can be formed of molded plastic, fiberglass, composites, etc. Also, various control and electrical components or devices described above can be in communication electrically or wirelessly, depending upon the situation at hand.

What is claimed is:

1. A tilting apparatus for an aerial lift comprising:

a support frame for supporting an operator within top, bottom, front and sides of the support frame, the support frame having a seat for supporting the operator when in an upright position and a chest support having a portion above and forward of the seat for supporting a chest of the operator when in a forwardly downward tilted position to allow arms of the operator to extend forwardly out of the support frame, the support frame having a longitudinal axis extending through the seat;

a support member pivotably mounted to at least one side of the support frame at a pivot joint that is located at an upper portion of the support frame when the support frame is in the upright position, for pivotably supporting the support frame, the pivot joint being positioned on the at least one side of the support frame along a lateral pivot axis that is located from more than 1/2 up to 70% of a height of the support frame and intersects the longitudinal axis that extends through the seat, above the seat and above a center of gravity of the support frame, thereby to approximate a location of the operator's shoulder joint during operation, and providing a radius of rotation about the pivot joint capable of remaining about a same distance from a work surface; and an actuator pivotally mounted at a first end to the support member at a point spaced from the pivot joint, and at a second end pivotally mounted to the support frame below the pivot joint for positionably rotating the support frame relative to the support member about the pivot joint between the upright position and the forwardly downward tilted position, since the pivot joint is located in the upper portion of the support frame, pivoting of the support frame from the upright position to the forwardly downward tilted position moves the center of gravity of the support frame rearwardly in the direction of the support member.

2. The tilting apparatus of claim 1 in which the support member includes connection hardware for securing to a lifting portion of the aerial lift.

3. The tilting apparatus of claim 1 in which the pivot joint is positioned on the support frame in a location that makes work activities easier.

4. The tilting apparatus of claim 3 in which the longitudinal axis is vertical when the support frame is in the upright position, the pivot joint being positioned along the longitudinal axis above the seat.

5. The tilting apparatus of claim 4 in which the support member is yoke shaped for pivotably supporting the support frame from two opposite sides.

6. The tilting apparatus of claim 1 in which the actuator comprises at least one of a linear actuator and a fluid or gas operated cylinder connected between the support frame and the support member for rotating the support frame about the pivot joint.

7. The tilting apparatus of claim 1 further comprising foot operated controls for controlling operation of the actuator.

8. The tilting apparatus of claim 1 further comprising a controller for controlling movement of the tilting apparatus.

9. The tilting apparatus of claim 8 further comprising a safety restraint for restraining the operator in the seat that is electrically connected to the controller for allowing movement of the tilting apparatus only when the safety restraint is closed.

10. The tilting apparatus of claim 8 further comprising one or more proximity sensors positioned on the support frame and electrically connected to the controller for controlling distance that the support frame can be moved toward an outside structure.

11. The tilting apparatus of claim 8 further comprising one or more break sensors positioned on the support frame and electrically connected to the controller for sensing presence of the operator's arms extending outside the support frame between the support frame and an outside structure and preventing movement of the support frame towards the outside structure to avoid pinching injuries of the operator's arms.

12. The tilting apparatus of claim 8 in which the controller includes position and orientation memory functions allowing the tilting apparatus to move to at least one previously determined desired location and/or orientation using the memory functions.

13. The tilting apparatus of claim 1 further comprising at least one of a rack, container, platform or basket attached to the support frame for carrying at least one of supplies, work materials and tools.

14. An aerial lift with a tilting apparatus comprising:

a lift base with a lifting portion;

a support frame for supporting an operator within top, bottom, front and sides of the support frame, the support frame having a seat for supporting the operator when in an upright position and a chest support having a portion above and forward of the seat for supporting a chest of the operator when in a forwardly downward tilted position to allow arms of the operator to extend forwardly out of the support frame, the support frame having a longitudinal axis extending through the seat;

a support member pivotably mounted to at least one side of the support frame at a pivot joint that is located at an upper portion of the support frame when the support frame is in the upright position, for pivotably supporting the support frame, the pivot joint being positioned on the at least one side of the support frame along a lateral pivot axis that is located from more than 1/2 up to 70% of a height of the support frame and intersects the longitudinal axis that extends through the seat, above the seat and above a center of gravity of the support frame, thereby to approximate a location of the operator's shoulder joint during operation, and providing a radius of rotation about the pivot joint capable of remaining about a same distance from a work surface, the support member being secured to the lifting portion of the aerial lift with connecting hardware; and an actuator pivotally mounted at a first end to the support member at a point spaced from the pivot joint, and at a second end pivotally mounted to the support frame below the pivot joint for positionably rotating the support frame relative to the support member about the pivot joint between the upright position and the forwardly downward tilted position, since the pivot joint is located in the upper portion of the support frame, pivoting of the support frame from the upright position to the forwardly downward tilted position moves the center of gravity of the support frame rearwardly in the direction of the support member.

* * * * *